United States Patent [19]

Schaich

[11] 4,408,574

[45] Oct. 11, 1983

[54] METHOD AND APPARATUS FOR FORMING FUEL-AIR MIXTURE IN AN INTERNAL COMBUSTION ENGINE

[76] Inventor: Josef Schaich, 118 Oschle, 7906 Markbronn, Fed. Rep. of Germany

[21] Appl. No.: 275,775

[22] Filed: Jun. 22, 1981

Related U.S. Application Data

[63] Continuation of Ser. No. 87,033, Oct. 22, 1979, abandoned.

[30] Foreign Application Priority Data

Oct. 25, 1978 [DE] Fed. Rep. of Germany ..... 2846416

[51] Int. Cl.[3] ..... F02M 67/02

[52] U.S. Cl. ..... 123/26; 123/533

[58] Field of Search ..... 123/531, 532, 533, 26, 123/316

[56] References Cited

U.S. PATENT DOCUMENTS

| | | | |
|---|---|---|---|
| 745,578 | 12/1903 | Dean | 123/533 |
| 923,054 | 5/1909 | Lietzenmayer | 123/533 |
| 960,057 | 5/1910 | Turnbull, Jr. | 123/533 |
| 1,079,578 | 11/1913 | Peterson | 123/26 |
| 1,262,982 | 4/1918 | Rabsilber | 123/533 |
| 1,279,775 | 9/1918 | Sprado | 123/531 |
| 1,597,060 | 8/1926 | Crossley et al. | 123/557 |
| 1,609,386 | 12/1926 | Streeter | 123/533 |
| 2,164,684 | 7/1939 | Kimmel | 123/32 |
| 3,792,691 | 2/1974 | Sahnas | 123/26 R |
| 4,149,497 | 5/1979 | Zeliszkewycz | 123/34 R |
| 4,191,135 | 3/1980 | Nohira et al. | 123/316 X |

*Primary Examiner*—Tony M. Argenbright

*Attorney, Agent, or Firm*—Albert L. Jeffers; John F. Hoffman

[57] ABSTRACT

The method and device for the formation of a fuel-air mixture upstream of the mixture-forming nozzles of an internal combustion engine. The combustible fuel is vaporized and introduced into a combustion chamber through a fuel vapor passage and nozzles, and an air pump connected to the fuel vapor passage introduces pressurized air therein at a selected time in the engine cycle. This results in the discharge of pressurized air together with vaporized fuel through the nozzle into the combustion chamber to form a zone of fuel-air mixture enveloped by a jacket of air during the compression stroke of the engine and protect the nozzles and fuel passages against the hot combustion gases. Air without fuel is then discharged into the combustion chamber during combustion of the vaporized fuel. An auxiliary air chamber connected to the main chamber of the air pump through a valve that is opened and closed at selected times during the cycle of the engine serves to increase the mass of gas delivered by the pump.

3 Claims, 2 Drawing Figures

Air pump delivery curve

Fuel pump delivery curve

METHOD AND APPARATUS FOR FORMING FUEL-AIR MIXTURE IN AN INTERNAL COMBUSTION ENGINE

This is a continuation-in-part of application Ser. No. 087,033, filed Oct. 22, 1979, now abandoned.

The present invention relates to a device for the formation of a fuel-air mixture upstream of the mixture-forming nozzles of an internal combustion engine of the type described in detail in copending patent application No. 957,661, filed Nov. 3, 1978, now abandoned.

In the known internal combustion engines of this type, a vaporized fuel-air mixture is blown into the cylinder or into a chamber communicating with the cylinder so that it becomes mixed with the total amount of air present in the cylinder or chamber.

The pressure gradient between the fuel vaporizing device and the cylinder and the time in the engine cycle at which the said vaporized fuel-air mixture is blown into the cylinder or the said chamber may vary within wide limits.

It is a feature of the invention disclosed here in detail that the time in the engine cycle at which the vaporized fuel-air mixture is blown into the cylinder and, in particular, the changing pressure gradient between the fuel vaporizing device and the cylinder are of special importance.

While the vaporized fuel-air mixture is blown into the cylinder, the change in pressure within the fuel vaporizing device is approximately equal to the change in pressure within the cylinder and the differential pressure between the fuel vaporizing device and the cylinder increases in substantially proportional relationship to the pressure rise within the cylinder.

It is an object of this invention to form a fuel-air mixture upstream of the mixture-forming nozzles which, when discharged from said mixture-forming nozzles, will form a further fuel-air mixture enclosed by a jacket of air with the air flowing in the piston-swept and compression spaces of the engine. A further object of the present invention consists in discharging air from said mixture-forming nozzles after completion of mixture formation and before completion of the combustion process in order to produce a turbulence in the piston-swept and compression spaces, to protect the nozzles and lines against burning gases and to prevent coking at the nozzles. These objects are accomplished by means of the measures detailed in the appended claims.

Gasoline, after carburetion, requires a relatively small volume at a given pressure and temperature. In order to increase the mass of gas which is blown into the cylinder space by means of the nozzles provided in the compression space of the engine, it may be expedient to add alcohol, water or air to the fuel. The resultant increase in the gas mass increases the impetus of the gas flow from the nozzles at a given nozzle cross section. The reach of the gas jets can be increased, thereby enabling a given mass of fuel to be distributed over a larger mass of air.

If a fuel-air mixture is blown in, the air can be delivered by a reciprocating pump. The delivery of the air pump is substantially determined by the following parameters: speed, piston-swept and compression space volumes, air density, air pressure and air temperature. The operating parameters of the air pump must be matched to those of the engine and the fuel pump. In order to maintain the pressure gradient between air pump and engine for the formation of a mixture zone enveloped by an air jacket, taking into account the air leaving the air pump during delivery and the fuel leaving the fuel pump and considering the fact that the pressure gradient varies during engine operation and mixture formation, it is important to match, among other things, the plunger-swept and compression volumes of the air pump, the compression ratio of the air pump, the volume of the air line downstream of the air pump and the air temperature upstream and downstream of the air pump to the various operating parameters of the fuel pump and of the engine. The delivery of the air pump can be matched to the specific vaporized fuel blow-in characteristics of the engine and of the fuel pump by providing a variable angular position of the air pump crank drive with respect to the engine crank drive and/or by dividing the air flow delivered by the air pump. Varying the angular position of the pump crank drive between 0° and 40°, for example, with respect to the engine crank drive results in a lead of the pump plunger over the engine piston so that the pressure gradient between pump and engine is increased. This can be accomplished by a valve controlled by means of mechanical or electric actuators with a partial flow of air being returned to atmosphere. Alternatively, a cam with a follower acting on the plunger of the air pump may be used instead of the crank drive. By an appropriate design of the cam and cam follower shapes, by appropriately selecting the position of the cam and by matching the operating parameters of the pump to those of the engine and fuel pump an air flow can be achieved which, together with the vaporized fuel in the cylinder of the engine, will form jets of vaporized fuel for the formation of a mixture zone enveloped by an air jacket.

By deliberately changing the amount of air upstream of the mixture-forming nozzles, the volume of the mixture zone and the excess-air factor in the mixture zone can be varied and the excess-air factor thus be adapted to specific operating parameters substantially without delay while the air delivered by the air pump mainly serves to achieve a better distribution. This is also possible at high engine speed and a high velocity of the air in the cylinder. In the configuration incorporating a cam, it may be expedient to vary the angular position of the cam with respect to the angular position of the engine crankshaft while the engine is running.

An appropriate design of the air pump and controlled delivery obviates the need for varying the nozzle cross section and the temperature of the vaporized fuel need only be regulated as far as this is necessary to maintain the temperature of the fuel-air mixture substantially constant upstream of the mixture forming nozzles. No burning gases enter the nozzles and lines when air without fuel is pumped into the line, at a pressure rising slightly above the final combustion pressure, on completion of the mixture formation process. Consequently, only air is discharged from the nozzles during and after combustion. There is no coking at the nozzles. A relief valve is not required in the fuel line. The formation of a fuel-air mixture upstream of the mixture-forming nozzles also has a favorable effect on the boiling curve of the fuel-air mixture employed.

Part of the air flow delivered by the said air pump may be directed into the line leading to the nozzles which form the ignitable mixture at a few crank angle degrees before ignition takes place via a mechanically actuated valve and a further line. Formation of the clouds of ignitable mixture is greatly facilitated by blowing in a fuel-air mixture, especially in a cold engine or at low temperatures. Furthermore, it is expedient to feed the air flow or air flows delivered by the air pump to the vaporized fuel in the fuel vaporizing device.

The mass of air delivered by the air pump can be increased by providing a small, auxiliary chamber in the cylinder head which communicates with the main cylinder of the air pump through a port closed by a valve which can be actuated mechanically, hydraulically or electrically in synchronism with the cycling of the engine. The plunger of the air pump pumps air into the auxiliary chamber which is closed on the next intake stroke of the plunger so that a further charge of air is drawn into the main cylinder of the air pump. The valve to the auxiliary chamber opens when the pump plunger is near its bottom dead center position on completion of the second intake stroke so that two charges are in the pump cylinder during the power stroke of the pump plunger. This arrangement raises the pressure level of the air pump and increases the amount of air that is delivered to the cylinder of the engine.

Figure 1:
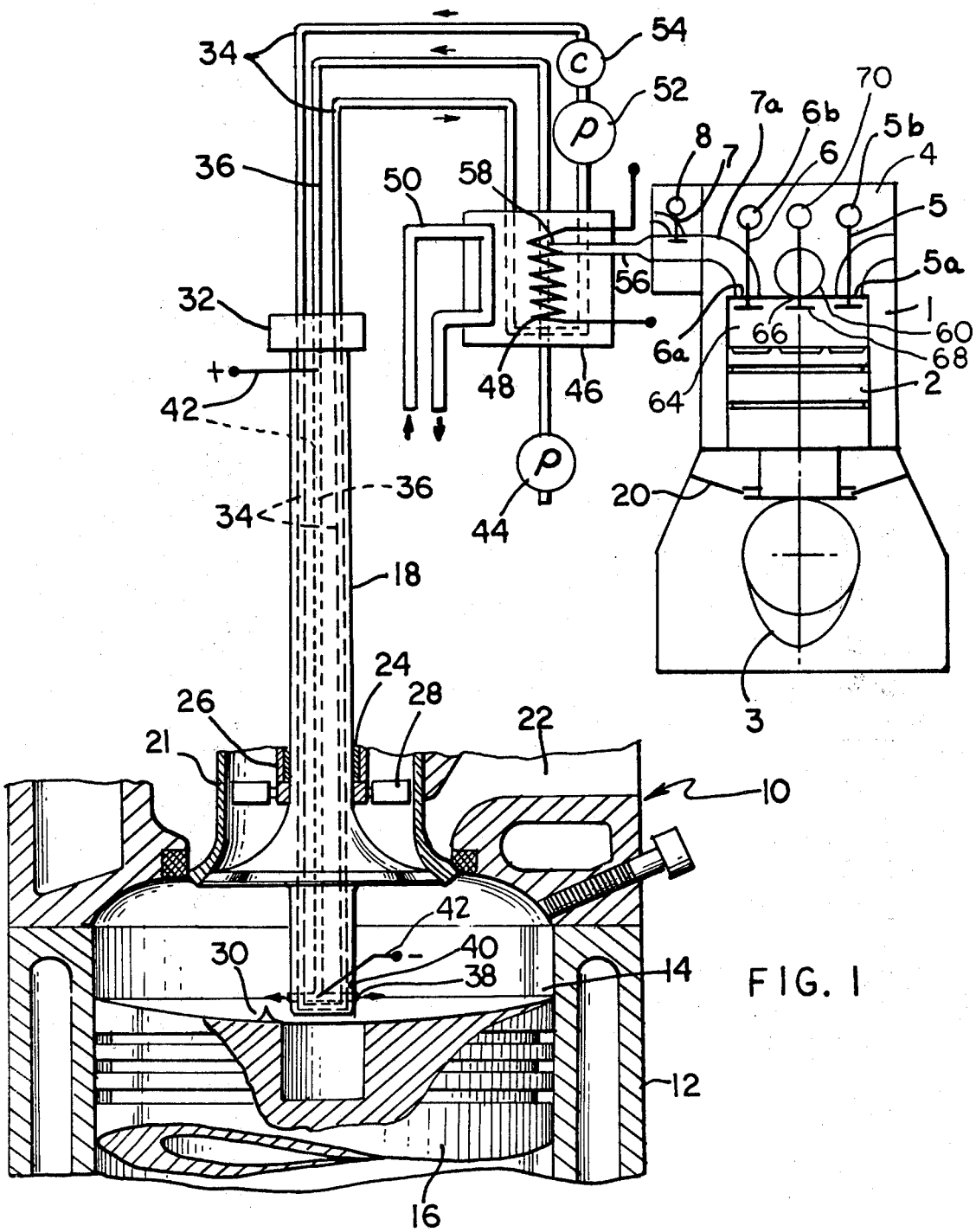
FIG. 1 is a fragmentary view of an internal combustion engine incorporating the present invention.
Figure 2:
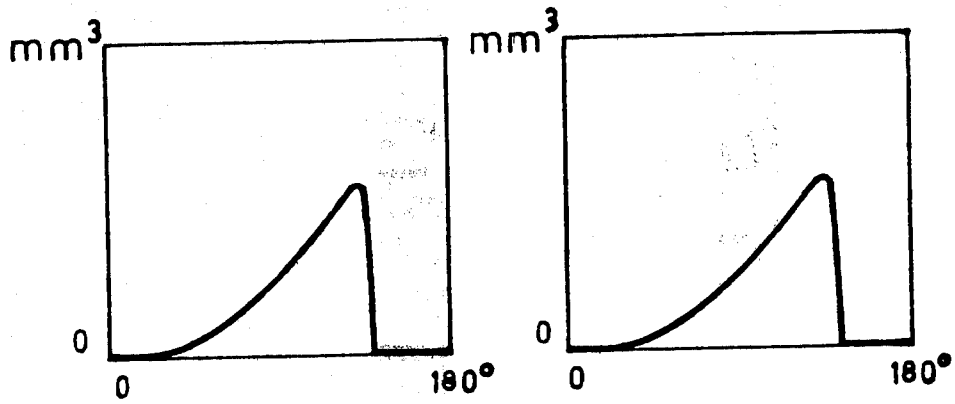
FIG. 2 shows examples of the characteristic curves of fuel pump and air pump delivery.

The air pump essentially consists of a cylinder 1 with a plunger 2 reciprocating within said cylinder 1, a cam 3 acting on said plunger 2 and return springs 20. The air pump cam is driven by the engine and is preferably mechanically connected to either the engine crankshaft or camshaft through suitable drive means. The cylinder head 4 is provided with an inlet port 5*a* with inlet valve 5 and an outlet port 6*a* with outlet valve 6. The valves 5, 6 are controlled mechanically by means of camshaft 5*b* and 6*b* synchronized with cam 3. A third valve 7, disposed in the air line 7*a*, is controlled mechanically by means of a three-dimensional cam 8 which can be shifted along its axis of rotation. The air flow delivered by the air pump may be controlled by appropriately dividing the compressed air, and an actuator positions the cam 8 acting on the valve 7. The control impulses for the actuator are provided by an electronic control unit which processes various operating parameters such as engine speed, position of accelerator pedal, angle of incidence of guide vanes and the temperature in the fuel vaporizing device and in the region of the nozzles disposed in the compression space, all monitored by appropriate sensors.

An auxiliary chamber 60 is provided within cylinder head 4 and is in communication with the bore 64 of cylinder 1 through port 66. Port 66 is opened and closed by valve 68, which is actuated by a cam 70 mechanically linked to the engine in the conventional manner so that it rotates in synchronism therewith. Due to the wide variety of conventional cam-valve structures for internal combustion engines, further details thereof are not necessary for an understanding of the present invention.

On the downward intake stroke of the plunger 2 of the air pump, air is drawn into bore 64 through inlet port 5*a*, and during the next compression stroke of plunger 2, valve 68 is opened and valves 5 and 6 are closed so that all of the air within bore 64 is forced into auxiliary chamber 60. At the top dead center position of plunger 2, valve 68 is then closed by cam 70. During the next intake stroke of plunger 2, valve 5 is opened and a second charge of air is drawn into cylinder bore 64. Valve 68 is opened and valve 5 is closed when plunger 2 is at or near its bottom dead center position so that two charges of air are within bore 64 during the next compression stroke of plunger 2. During this next stroke, valve 6 opens thereby permitting the double charge of air to be blown into the fuel vaporizing device through air line 7*a*. The cam 3 actuating plunger 2 is preferably driven at the same speed as the crankshaft of the engine.

A control loop with appropriate sensors, a computer and appropriate actuators must be provided for maintaining the basic temperature in the fuel vaporizing device and a further control loop is required for controlling the oil pump and, thus, the temperature of the fuel vapor in the nozzle and electrode carrier.

If necessary, additional heat energy can be applied to the fuel vaporizing device by means of hot exhaust gases flowing through pipes.

Appropriate use of PTC resistors, electronic control devices and actuators enables the parameters of the fuel-air mixture upstream of the engine nozzles to be matched to the other parameters, especially those related to the air swirl, via the air pump in such a manner that the process may be optimized in terms of consumption and pollutant emission.

The fuel system according to the invention is shown installed in an internal combustion engine including a cylinder head 10, block 12 having cylinder 14 in which piston 16 reciprocates. The intake valve 18 is mounted within a tubular valve 21, which controls the flow of exhaust gases through exhaust port 22. Intake valve 18 is mounted for reciprocation within sleeve 24, which in turn is positioned internally of sleeve 26. Sleeve 26 carries movable guide vanes 28. Piston 16 carries at its rim a spoon-like element 30. Further details of the cylinder and valve arrangement shown are disclosed in applicant's copending U.S. Application Ser. No. 957,661 filed Nov. 3, 1978.

The intake valve 18 accommodates the nozzle and electrode carrier 32. The oil ducts disposed in the nozzle and electrode carrier 32 are denoted by the numeral 34 while the fuel line extending next to the oil ducts 34 is identified by the numeral 36. The line leading to the nozzle or nozzles forming the ignitable mixture and the nozzles themselves are not shown in the drawing. The nozzles in the end region of the nozzle and electrode carrier 32 are denoted by the numeral 38. A PTC resistor 40 is provided in the region of the nozzles 38. The electrodes in the region of the nozzles 38 are denoted by the numeral 42.

The fuel pump 44 pumps the liquid fuel through a line to the heat exchanger/fuel vaporizing device 46. Thermal energy is applied to the fuel vaporizing device 46 by means of the first electric heating system 48 and by means of the engine exhaust gases flowing through the pipes 50. Additional heat energy may be applied to the fuel vaporizing device 46 by means of the cooling oil returning from the nozzle and electrode carrier 32. The oil circuit incorporates a circulating pump 52 and the rate of circulation can be controlled. An oil cooler 54 may be provided in the region of the oil pump 52 and the oil line 34 leading to the nozzle and electrode carrier 32.

Air line 56 is connected to fuel line 36 at T junction 58.

While this invention has been described as having a preferred design, it will be understood that it is capable of further modification. This application is, therefore, intended to cover any variations, uses, or adaptations of the invention following the general principles thereof and including such departures from the present disclosure as come within known or customary practice in the art to which this invention pertains and fall within the limits of the appended claims.

What is claimed is:

1. A mixture formation device in an internal combustion engine comprising: fuel vaporizing means for producing fuel vapor, engine nozzle means connected to said vaporizing means by a fuel vapor passage for introducing fuel vapor into a combustion chamber, and an air pump means connected to said fuel vapor passage for introducing pressurized air into said fuel vapor passage at a selected time in the engine cycle, said air pump means comprising a cylinder and a plunger therein, valve means connecting said cylinder with said combustion chamber, means synchronized with said engine for reciprocating said plunger in said cylinder, an auxiliary chamber communicating with said cylinder, and a valve means for opening and closing the communication between said chamber and cylinder on selected strokes of said plunger.

2. The method of replacing fuel by air and building up pressure in a fuel passage of an internal combustion engine having a combustion chamber comprising: blowing by means of a fuel pump and an air pump a quantity of fuel mixed with air through a fuel passage and a nozzle connected with the fuel passage into the combustion chamber of the internal combustion engine with a gas pressure of the fuel-air mixture produced by the fuel pump and air pump, the nozzle opening directly into the combustion chamber, substantially replacing the fuel-air mixture in the fuel passage by air on completion of mixture formation in the combustion chamber of the engine and substantially maintaining the gas pressure of the air in the fuel passage at a value above the gas pressure in the combustion chamber during combustion of the fuel-air mixture in the combustion chamber.

3. The method of claim 2 including developing an auxiliary charge of pressurized air in a closed auxiliary chamber connected to the fuel passage and opening the auxiliary chamber to cause the second charge of pressurized air to join air already in the fuel passage.

* * * * *